US007097432B1

(12) United States Patent
Lombard et al.

(10) Patent No.: US 7,097,432 B1
(45) Date of Patent: Aug. 29, 2006

(54) SLIDING VANE TURBOCHARGER WITH GRADUATED VANES

(75) Inventors: Alain Rene Lombard, Thaon-les-Vosges Cedex (FR); Jean-Luc Hubert Perrin, Thaon-les-Vosges Cedex (FR)

(73) Assignee: Honeywell International, Inc., Morristown, NJ (US)

( * ) Notice: Subject to any disclaimer, the term of this patent is extended or adjusted under 35 U.S.C. 154(b) by 352 days.

(21) Appl. No.: 10/333,405

(22) PCT Filed: Jul. 19, 2000

(86) PCT No.: PCT/FR00/02069

§ 371 (c)(1),
(2), (4) Date: Jul. 23, 2003

(87) PCT Pub. No.: WO02/06636

PCT Pub. Date: Jan. 24, 2002

(51) Int. Cl.
*F04B 49/03* (2006.01)

(52) U.S. Cl. ..... 417/295; 417/71; 417/72; 415/177; 415/199; 415/164; 415/165; 415/157; 415/158

(58) Field of Classification Search ..... 417/71, 417/72, 295; 415/126, 177, 199, 191, 163, 415/164, 165, 158, 150, 157
See application file for complete search history.

(56) References Cited

U.S. PATENT DOCUMENTS

| | | | | |
|---|---|---|---|---|
| 2,914,300 | A * | 11/1959 | Sayre | 415/135 |
| 3,749,513 | A | 7/1973 | Chute | |
| 3,836,282 | A * | 9/1974 | Mandelbaum et al. | 415/209.4 |
| 4,557,665 | A | 12/1985 | Szczupak | |
| 4,726,744 | A * | 2/1988 | Arnold | 417/407 |
| 5,248,240 | A * | 9/1993 | Correia | 415/209.1 |
| 5,441,383 | A * | 8/1995 | Dale et al. | 415/158 |
| 6,694,733 | B1 * | 2/2004 | Bernardini et al. | 60/602 |

FOREIGN PATENT DOCUMENTS

| | | |
|---|---|---|
| DE | 42 18 229 | 3/1993 |
| DE | 42 32 400 | 8/1993 |
| EP | 0 569 702 | 11/1993 |
| EP | 0 571 205 | 11/1993 |

* cited by examiner

*Primary Examiner*—Tae Jun Kim
*Assistant Examiner*—Emmanuel Sayoc
(74) *Attorney, Agent, or Firm*—Chris James

(57) ABSTRACT

A turbocharger having a variable geometry turbine inlet incorporating a cylindrical piston movable to vary the area of the inlet nozzle into the turbine. Vanes mounted to the piston for flow control in the nozzle are received through a slotted heat shield which provides smooth aerodynamic flow into the turbine blades. The vanes additionally incorporate a step having larger cord and depth that engages the surface of the heat shield and seals the slots with the piston in a closed position. An axial actuator is attached for operation of the piston.

7 Claims, 6 Drawing Sheets

SLIDING VANE TURBOCHARGER WITH GRADUATED VANES

BACKGROUND OF THE INVENTION

1. Field of the Invention

The present invention relates generally to variable geometry turbochargers. More particularly, a turbocharger is provided having a sliding vane variable nozzle turbine inlet with vanes received through a slotted sheet metal heat shield suspended within the turbine housing and the vanes have a stepped shape for sealing against the surface of the heat shield 2. Description of the Related Art High efficiency turbochargers employ variable geometry systems for turbine nozzle inlets to increase performance and aerodynamic efficiency. Variable geometry systems for turbochargers have typically been of two types; rotating vane and piston. The rotating vane type exemplified by U.S. Pat. No. 5,947,681 entitled PRESSURE BALANCED DUAL AXLE VARIABLE NOZZLE TURBOCHARGER provide a plurality of individual vanes placed in the turbine inlet nozzle which are rotatable to decrease or increase nozzle area and flow volume. The piston type, which is exemplified by U.S. Pat. No. 5,214,920 and 5,231,831 both entitled TURBOCHARGER APPARATUS, and U.S. Pat. No. 5,441,383 entitled VARIABLE EXHAUST DRIVEN TURBOCHARGERS, employs a cylindrical piston or wall which is movable concentric with the axis of rotation of the turbine to reduce the area of the nozzle inlet. In most cases, the piston type variable geometry turbocharger incorporates vanes with fixed angle of attack with respect to the airflow, which are either mounted to the piston or a stationary nozzle wall opposite the piston and are received in slots in the opposing surface during motion of the piston.

In piston type variable geometry turbochargers in the prior art, the challenge has been maximizing aerodynamic performance balanced with tolerancing of mating surfaces, particularly of the vanes and receiving slots that are subjected to extreme temperature variation and mechanical stress, as well as providing means for actuating the piston in a readily manufacturable configuration.

SUMMARY OF THE INVENTION

A turbocharger incorporating the present invention has a case having a turbine housing receiving exhaust gas from an exhaust manifold of an internal combustion engine at an inlet and having an exhaust outlet, a compressor housing having an air inlet and a first volute, and a center housing intermediate the turbine housing and compressor housing. A turbine wheel is carried within the turbine housing for extracting energy from the exhaust gas. The turbine wheel is connected to a shaft extending from the turbine housing through a shaft bore in the center housing and the turbine wheel has a substantially full back disc and multiple blades. A bearing carried in the shaft bore of the center housing supports the shaft for rotational motion and a compressor impeller is connected to the shaft opposite the turbine wheel and enclosed within the compressor housing.

A substantially cylindrical piston is concentric to the turbine wheel and movable parallel to an axis of rotation of the turbine wheel. A plurality of vanes extend substantially parallel to the axis of rotation from a first end of the piston proximate the back disc. A heat shield is engaged at its outer circumference between the turbine housing and center housing and extends radially inward toward the axis of rotation.

The heat shield has a plurality of slots receiving the vanes. An actuator is provided for moving the piston from a first position wherein the first end is proximate the heat shield to a second position wherein the first end is distal the heat shield. The vanes have a first portion sized to be received within the slots and a second portion or step, intermediate the first portion and the piston sized to engage the surface of the heat shield and cover the slot with the piston in the first position.

BRIEF DESCRIPTION OF THE DRAWINGS

The details and features of the present invention will be more clearly understood with respect to the detailed description and drawings in which.

DETAILED DESCRIPTION OF THE INVENTION

Figure 1:
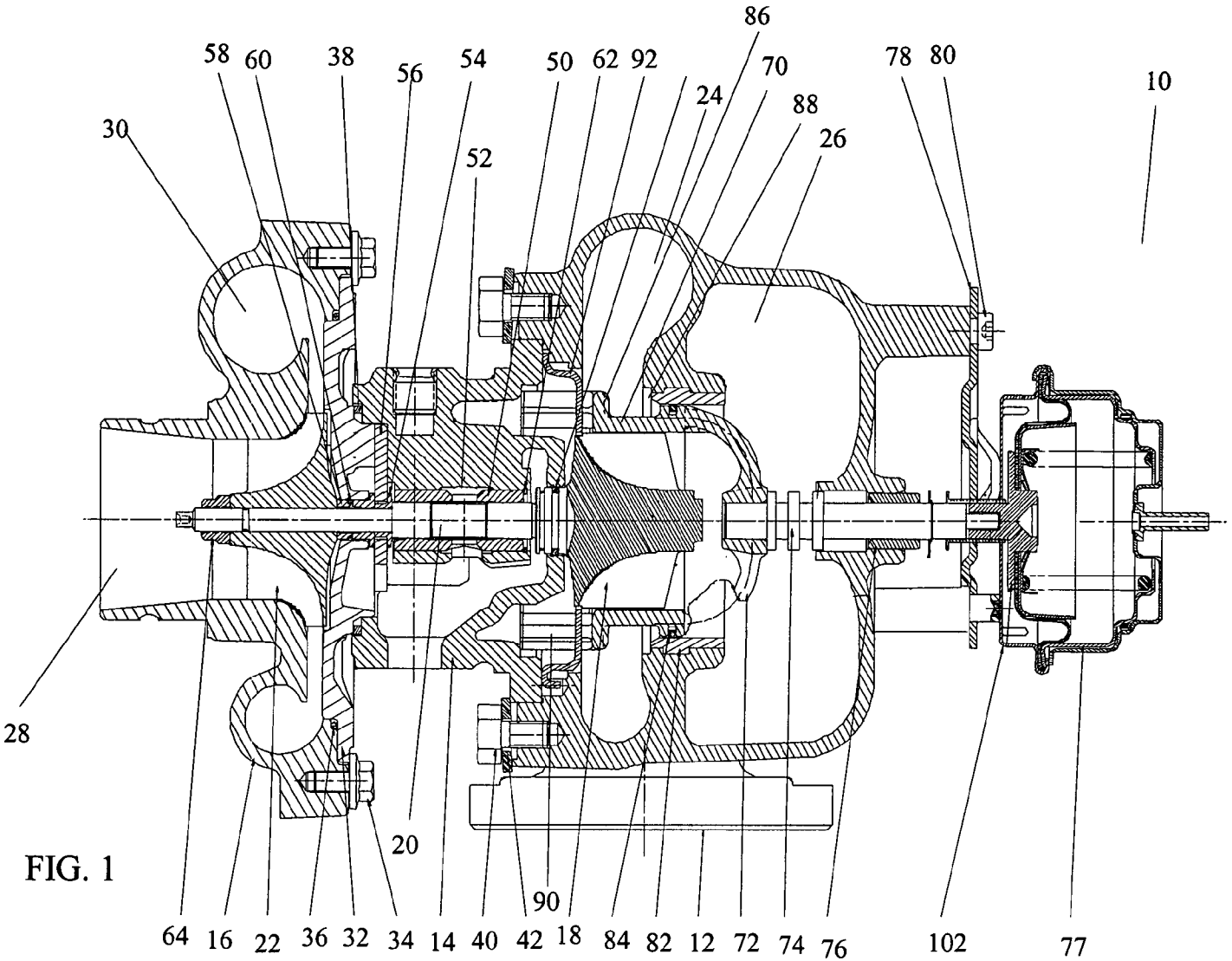
FIG. 1 is a cross-section elevation view of a turbocharger employing an embodiment of the invention.

Referring to the drawings, FIG. 1 shows an embodiment of the invention for a turbocharger 10 which incorporates a turbine housing 12, a center housing 14 and a compressor housing 16. Turbine wheel 18 is connected through shaft 20 to compressor wheel 22. The turbine wheel converts energy from the exhaust gas of an internal combustion engine provided from an exhaust manifold (not shown) to a volute 24 in the turbine housing. The exhaust gas is expanded through the turbine and exits the turbine housing through outlet 26.

The compressor housing incorporates an inlet 28 and an outlet volute 30. A backplate 32 is connected by bolts 34 to the compressor housing. The backplate is, in turn, secured to the center housing using bolts (not shown). A first ring seal 36 is engaged between the backplate and compressor housing and a second ring seal 38 is engaged between the backplate and center housing. Bolts 40 and attachment washers 42 connect the turbine housing to the center housing.

Journal bearings 50 mounted in a shaft bore 52 of the center housing rotationally support the shaft. A thrust collar 54 mounted to the shaft adjacent the compressor wheel engages a thrust bearing 56 constrained between the center housing and backplate for the embodiment shown. A sleeve 58 is engaged intermediate the thrust collar and compressor wheel. A rotating seal 60, such as a piston ring, provides a seal between the sleeve and backplate. A circlip 62 constrains the journal bearing within the bore and a nut 64 constrains the compressor wheel and bearing components on the shaft.

The variable geometry mechanism for the present invention includes a substantially cylindrical piston 70 received within the turbine housing concentrically aligned with the rotational axis of the turbine. The piston is longitudinally movable by a spider 72, having three legs in the embodiment shown, attaching to the piston and attaching to an actuating shaft 74. The actuating shaft is received in a bushing 76 extending through the turbine housing and connects to an actuator 77. For the embodiment shown, the actuator is mounted to standoffs on the turbine housing using a bracket 78 and bolts 80.

The piston slides in the turbine housing through a low friction insert 82. A cylindrical seal 84 is inserted between the piston and insert. The piston is movable from a closed position shown in FIG. 1, substantially reducing the area of the inlet nozzle to the turbine from the volute 24. In a fully open position, a radial projection 86 on the piston is received in relief 88 that limits the travel of the piston.

Nozzle vanes 90 extend from the radial projection on the piston. In the closed position of the piston, the vanes are accommodated in a relieved portion of the center housing casting. A heat shield 92 is engaged between the turbine housing and center housing. The shield is contoured to extend into the cavity of the turbine housing from the interface between the center housing and turbine housing and provide and inner wall for the turbine inlet nozzle.

Figure 2:
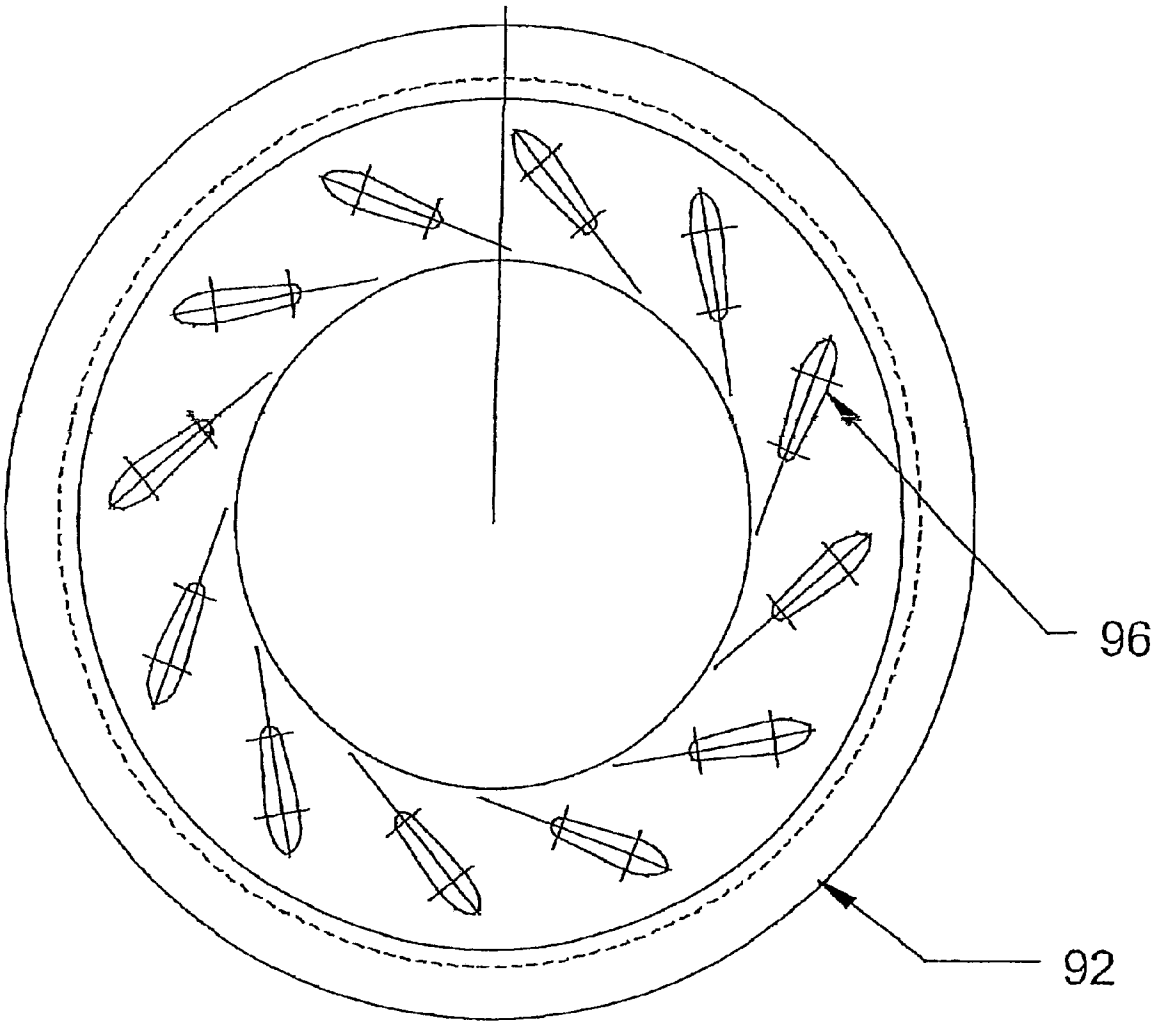
FIG. 2 is a top view of the heat shield.
Figure 4:
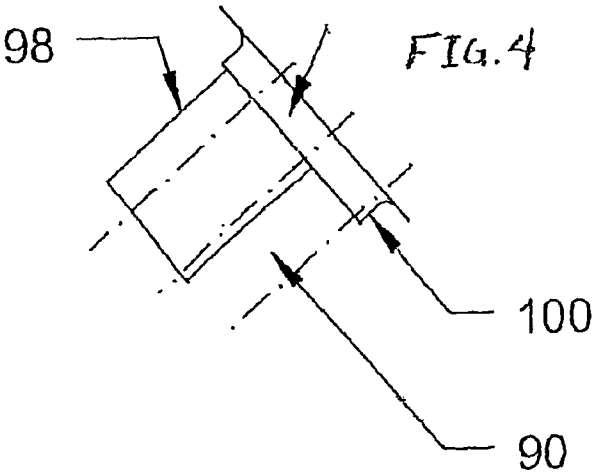
FIG. 4 is a side view of one of the vanes.
Figure 3:
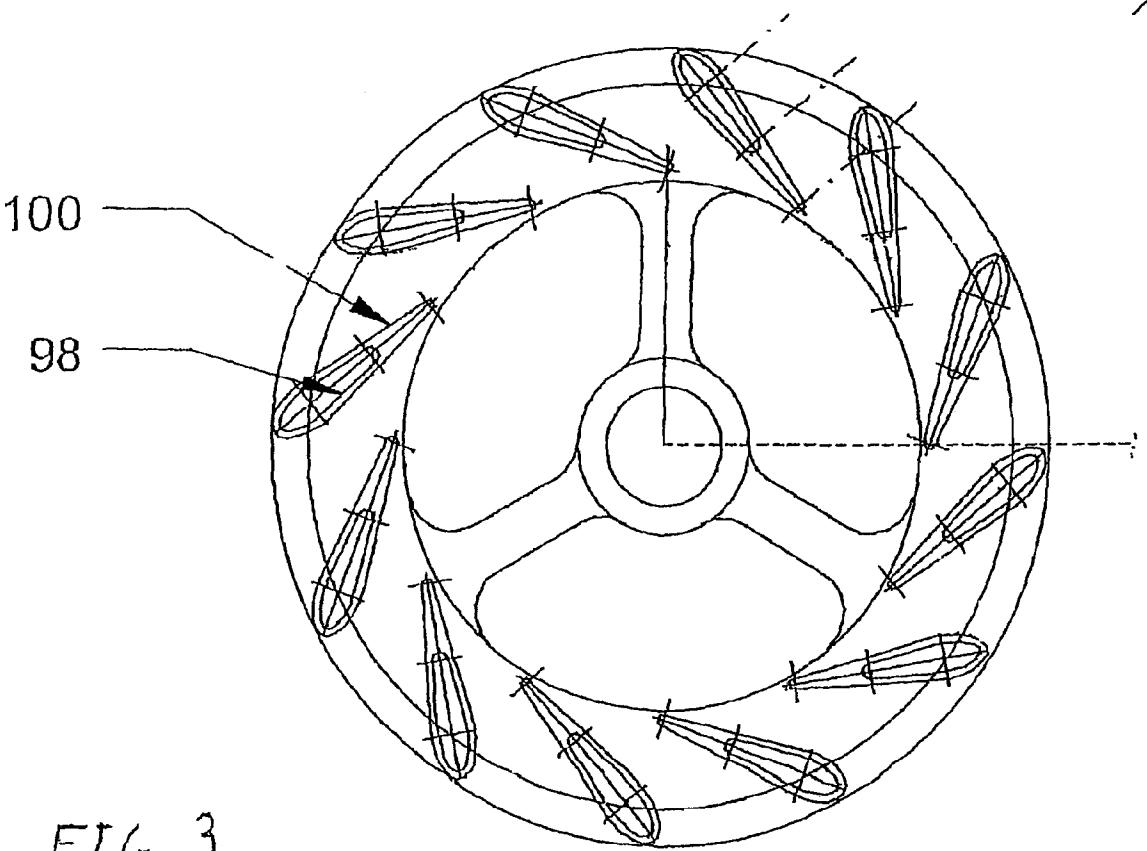
FIG. 3 is a bottom view of the piston with the attached vanes.
Figure 5A:
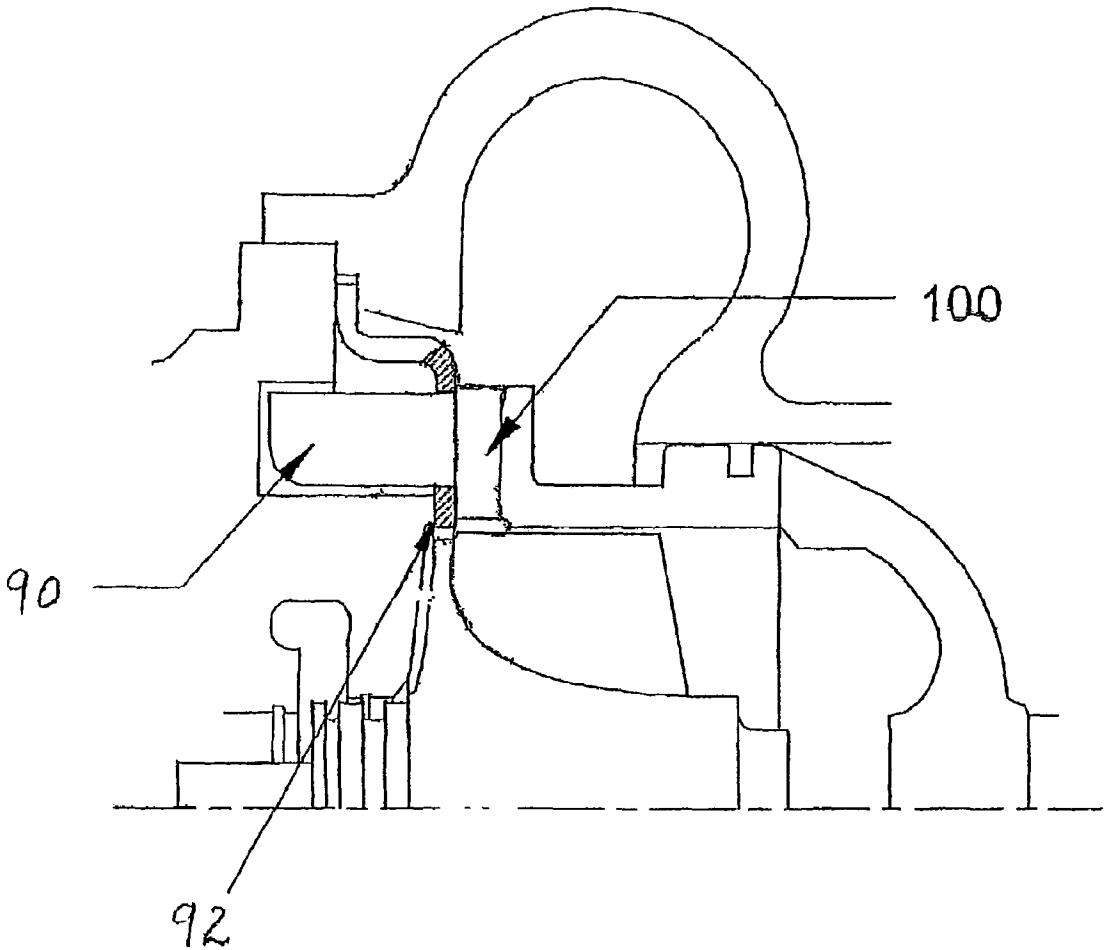
FIG. 5*a* is a partial side view of the turbocharger incorporating the present invention showing the detail of the vane step engagement of the heat shield with the piston in the closed position.
Figure 5B:
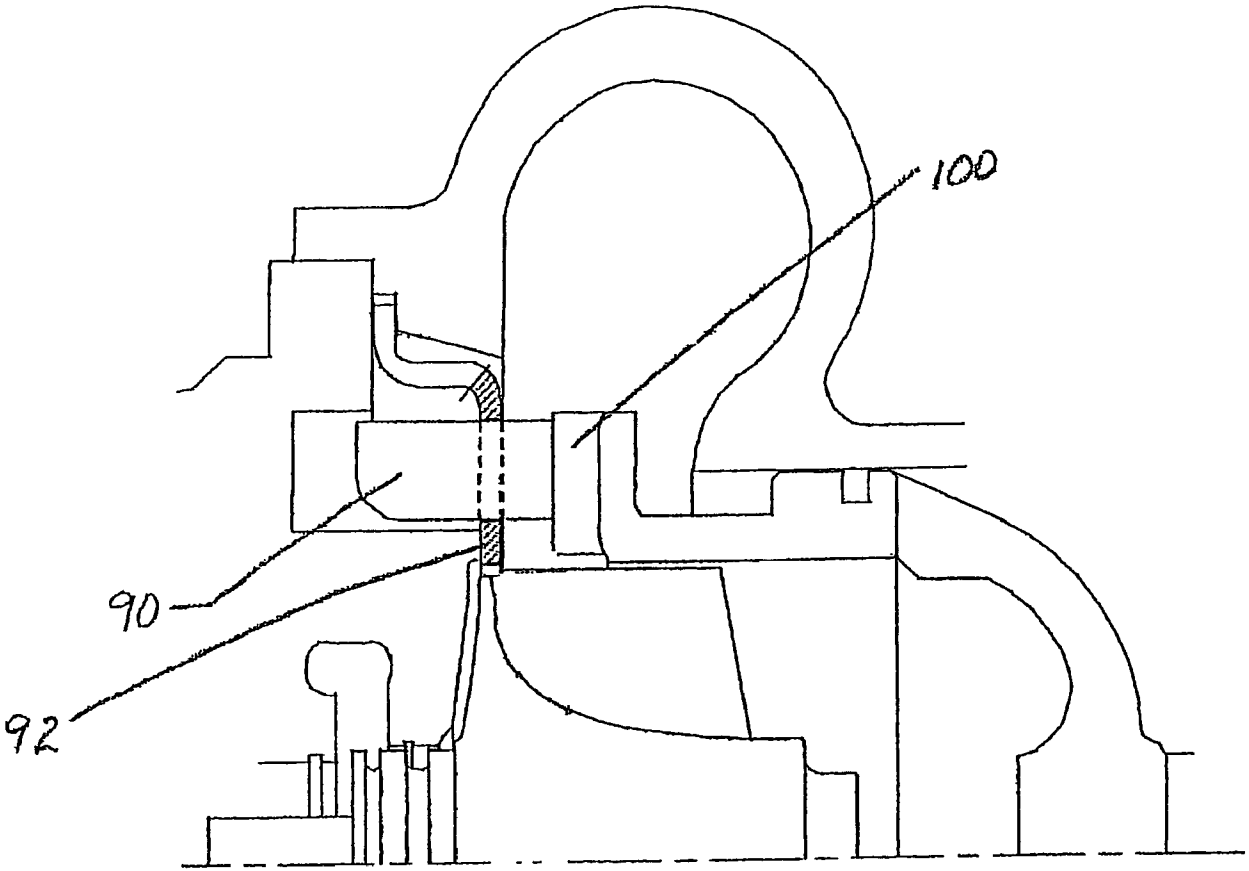
FIG. 5*b* is a partial side view of the turbocharger incorporating the present invention showing the detail of the vane step engagement of the heat shield with the piston in the open position.
Figure 6B:
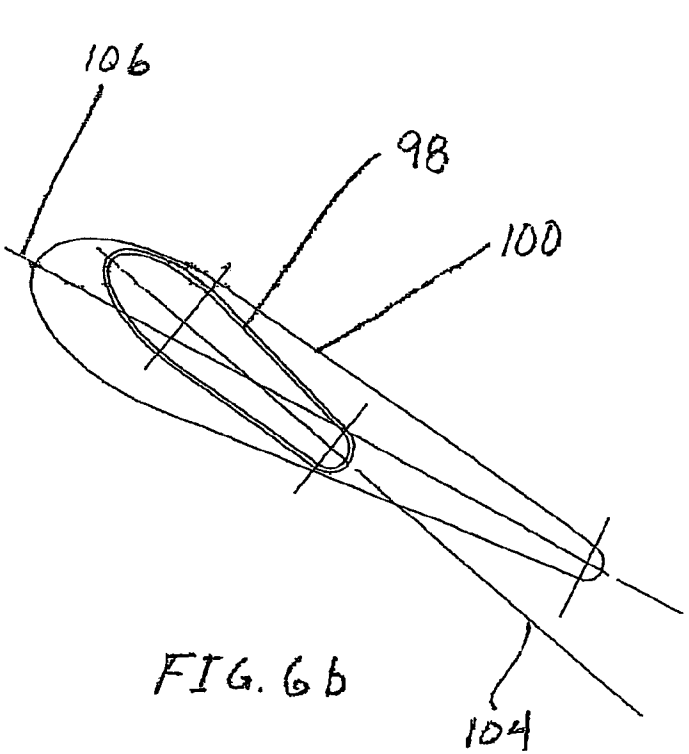
FIG. 6*b* is a detail view of an alternative embodiment of the blade and step footprint with the step cord line at an angle to the blade cord line.
Figure 6A:
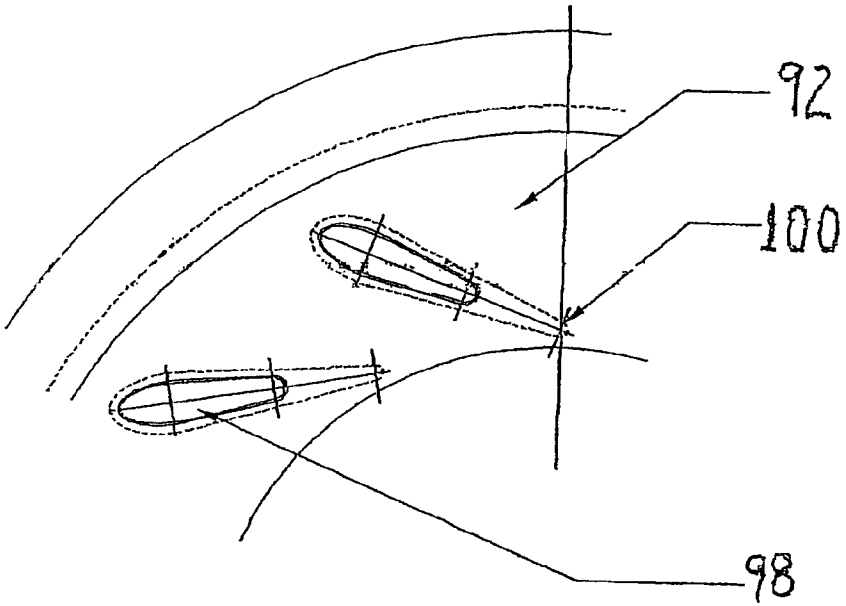
FIG. 6*a* is a bottom view of the heat shield showing in phantom lines the footprint of the step on the vanes which seals the slots.

FIG. 2 shows the heat shield incorporating closed slots 96 for receiving the vanes 90. As shown in FIGS. 3 and 4, the vanes have a first portion 98 which is received in the slots and a second portion 100 in the form of a step which is longer in cord and depth to exceed the size of the slot. As shown in FIG. 5*b*, the piston is in a partially open position. When the piston in a fully open position, the nozzle area for the turbine inlet is sized for maximum flow into the turbine. With the piston in the closed position, as seen in FIG. 5*a*, the first portion of the vanes is received within the slots and the second portion or step on the vanes engages the surface of the heat shield. The step seals the slot in the heat shield to avoid excessive leakage of the turbine inlet flow, as best seen in FIG. 6*a*. The aerodynamic shape of the step maintains smooth flow of the inlet stream in both the closed and open positions of the piston. FIG. 6*b* demonstrates an alternative embodiment of the stepped blade with the cord of the step, represented by line 106, set in angled relation to the cord of the blade, represented by line 104. This arrangement provides a modified angle of attack on the blade to the airflow in the open and closed position of the piston for enhanced aerodynamic control.

The actuation system for the piston in the embodiment shown in the drawings, is a pnuematic actuator 77 having a case bottom 102 attached to bracket 78 as shown in FIG. 1.

Having now described the invention in detail as required by the patent statutes, those skilled in the art will recognize modifications and substitutions to the specific embodiments disclosed herein. Such modifications and substitutions are within the scope and intent of the present invention as defined in the following claims.

What is claimed is:

1. A turbocharger comprising:

a case having a turbine housing receiving exhaust gas from an exhaust manifold of an internal combustion engine at an inlet and having an exhaust outlet, a compressor housing having an air inlet and a first volute, and a center housing intermediate the turbine housing and compressor housing;

a turbine wheel carried within the turbine housing and extracting energy from the exhaust gas, said turbine wheel connected to a shaft extending from the turbine housing through a shaft bore in the center housing;

a bearing carried in the shaft bore of the center housing, said bearing supporting the shaft for rotational motion;

a compressor impeller connected to the shaft opposite the turbine wheel and enclosed within the compressor housing;

a substantially cylindrical piston, concentric to the turbine wheel and movable parallel to an axis of rotation of the turbine wheel;

a plurality of vanes extending substantially parallel to the axis of rotation from a first end of the piston proximate a back disc of the turbine wheel, each vane having a first portion with a first cord and depth and a second portion intermediate the first portion and the first end of the piston, the second portion having a second cord and depth larger than the first cord and depth, the first and second portions being characterized in that the larger cord and depth of the second portion provides a step around the first portion;

a heat shield engaged at its outer circumference between the turbine housing and center housing and extending radially inward toward the axis of rotation, said heat shield further having a plurality of slots having cord and depth to closely receive the first portion of the vanes; and means for moving the piston from a first position wherein the first end is proximate the heat shield to a second position wherein the first end is distal the heat shield, the second portion of the vanes engaging the heat shield and sealing the slots with the piston in the first position.

2. A turbocharger as defined in claim 1 wherein the second portion of the vanes incorporates an aerodynamic shape to promote smooth flow of the turbine inlet gas.

3. A turbocharger comprising:

a case having a turbine housing receiving exhaust gas from an exhaust manifold of an internal combustion engine at an inlet and having an exhaust outlet, a compressor housing having an air inlet and a first volute, and a center housing intermediate the turbine housing and compressor housing;

a turbine wheel carried within the turbine housing and extracting energy from the exhaust gas, said turbine wheel connected to a shaft extending from the turbine housing through a shaft bore in the center housing, a bearing carried in the shaft bore of the center housing, said bearing supporting the shaft for rotational motion;

a compressor impeller connected to the shaft opposite the turbine wheel and enclosed within the compressor housing;

a substantially cylindrical piston, concentric to the turbine wheel and movable parallel to an axis of rotation of the turbine wheel;

a plurality of vanes extending substantially parallel to the axis of rotation from a first end of the piston proximate a back disc of the turbine wheel, each vane having a first portion with a first cord and depth and a second portion intermediate the first portion and the first end of the piston, the second portion having a second cord and depth larger than the first cord and depth;

a heat shield engaged at its outer circumference between the turbine housing and center housing and extending radially inward toward the axis of rotation, said heat shield further having a plurality of slots having cord and depth to closely receive the first portion of the vanes; and means for moving the piston from a first position wherein the first end is proximate the heat shield to a second position wherein the first end is distal the heat shield, the second portion of the vanes engaging the heat shield and sealing the slots with the piston in the first position;

wherein the second portion of the vanes incorporates an aerodynamic shape to promote smooth flow of the turbine inlet gas; and wherein the second portion of the vanes is angled in relationship to the first portion to provide a modified angle of attack for the airflow with the piston in the closed position.

4. A turbocharger for use with exhaust gas from an exhaust manifold of an internal combustion engine, comprising:

a turbine housing configured to receive exhaust gas from the exhaust manifold of the internal combustion engine at a housing inlet, and having a housing outlet to release the received exhaust gas;

a turbine wheel rotatably carried within the turbine housing and being configured to extract energy from exhaust gas passing between the housing inlet and the housing outlet;

a heat shield having a passage-surface defining a heat-shield side of an exhaust-gas passage configured for the passage of exhaust gas that is flowing from the housing inlet to the housing outlet;

a piston movable between an open position and a closed position, the closed position substantially reducing the area of the exhaust-gas passage, the piston having a passage-surface defining a piston side of the exhaust-gas passage;

a plurality of vanes extending between the piston passage-surface and the heat-shield passage-surface, each vane having a first longitudinal portion and a second longitudinal portion, each portion having a cord and depth, the second portion having a chord and depth larger than the cord and depth of the first portion;

wherein one of the passage surfaces is a slotted surface configured with a plurality of slots, each slot having a respective vane first portion slidably extending therethrough, each slot conforming to the chord and depth of its respective vane first portion;

wherein each second portion abuts the slotted surface when the piston is in the closed position; and wherein each first portion extends through its respective slot without its respective second portion abutting the slotted surface when the piston is in the open position.

5. A turbocharger as defined in claim 4, wherein the first and second portions of the vanes incorporate an aerodynamic shape to promote smooth flow of the exhaust gas.

6. A turbocharger as defined in claim 5, wherein the second portion of each vane is angled in relationship to its respective first portion so as to provide a different angle of attack for the airflow with the piston in the closed position.

7. A turbocharger as defined in claim 4, wherein the plurality of vanes each define a transition surface that transitions between the chord and depth of the first portion and the chord and depth of the second portion, and wherein the transition surface extends fully around the vane.

* * * * *